US010401107B2

(12) United States Patent
Martinez

(10) Patent No.: US 10,401,107 B2
(45) Date of Patent: Sep. 3, 2019

(54) TRIGGER MECHANISM FOR A FIREARM

(71) Applicant: M&M MFG LLC, Mesa, AZ (US)

(72) Inventor: Michael Martinez, Phoenix, AZ (US)

(73) Assignee: M&M MFG LLC, Mesa, AZ (US)

( * ) Notice: Subject to any disclaimer, the term of this patent is extended or adjusted under 35 U.S.C. 154(b) by 0 days.

(21) Appl. No.: 15/875,039

(22) Filed: Jan. 19, 2018

(65) Prior Publication Data

US 2018/0231342 A1 Aug. 16, 2018

Related U.S. Application Data

(60) Provisional application No. 62/457,390, filed on Feb. 10, 2017.

(51) Int. Cl.

| | |
|---|---|
| ***F41A 19/10*** | (2006.01) |
| ***F41A 19/12*** | (2006.01) |
| ***F41A 19/14*** | (2006.01) |

(52) U.S. Cl.

CPC ..... *F41A 19/10* (2013.01); *F41A 19/12* (2013.01); *F41A 19/14* (2013.01)

(58) Field of Classification Search

CPC ..... F41A 19/10; F41A 19/12; F41A 19/14

USPC ..... 42/69.03; 89/132, 136, 139, 144, 149, 89/150

See application file for complete search history.

(56) References Cited

U.S. PATENT DOCUMENTS

| | | | | |
|---|---|---|---|---|
| 4,308,786 | A * | 1/1982 | Hayashi | F41A 19/44 89/144 |
| 4,908,970 | A * | 3/1990 | Bell | F41A 19/12 42/69.01 |
| 5,487,233 | A * | 1/1996 | Jewell | F41A 19/16 42/69.01 |
| 5,881,485 | A * | 3/1999 | Milazzo | F41A 19/16 42/69.03 |
| 6,553,706 | B1 * | 4/2003 | Gancarz | F41A 17/46 42/69.02 |
| 7,398,723 | B1 * | 7/2008 | Blakley | F41A 19/12 42/69.01 |
| 7,421,937 | B1 * | 9/2008 | Gangl | F41A 17/46 42/69.03 |
| 8,667,881 | B1 * | 3/2014 | Hawbaker | F41A 19/46 42/69.01 |
| 2006/0086031 | A1 * | 4/2006 | Geissele | F41A 19/16 42/69.03 |
| 2015/0330734 | A1 * | 11/2015 | Kolev | F41A 3/12 42/69.01 |
| 2016/0363401 | A1 * | 12/2016 | Elftmann | F41A 19/15 |

* cited by examiner

*Primary Examiner* — Bret Hayes
(74) *Attorney, Agent, or Firm* — The Noblitt Group, PLLC

(57) ABSTRACT

A trigger mechanism according to various aspects of the present technology is configured to provide a more effective method of securing a hammer after a firearm is fired. Various embodiments of the trigger mechanism comprise a main sear and a sear link that are used to mechanically link a trigger body to the hammer. The main sear maintains engagement with the hammer throughout an actuation cycle and is configured to catch the hammer as it rotates after striking a round of ammunition.

15 Claims, 7 Drawing Sheets

TRIGGER MECHANISM FOR A FIREARM

CROSS-REFERENCES TO RELATED APPLICATIONS

This application claims the benefit of U.S. Provisional Patent Application No. 62/457,390, filed Feb. 10, 2017, and incorporates the disclosure by reference. To the extent that the present disclosure conflicts with any referenced application, however, the present disclosure is to be given priority.

BACKGROUND OF THE TECHNOLOGY

Weapon misfires are a dangerous situation commonly catching the user of the weapon off guard. Misfires come in various forms such as the unintended firing of a round, the firing of more rounds than intended, and the non-firing of a round. Many reasons may lead to a weapon misfire such as user error or poor quality ammunition. Mechanical error or failure, however, is also a major cause of weapon misfires and may create the most dangerous situations. For example, if a weapon malfunctions and fires a round without the user having pulled the trigger, the result can put innocent persons or animals at risk of being shot unintentionally. Weapon malfunctions may not be the direct result of a component failure but may instead result from a combination of factors that together cause a weapon to misfire. For example, the failure to effectively catch the hammer after a first round has been fired may result in the hammer inadvertently rotating forward causing a second round to be fired unintentionally. If the hammer is not caught after the second projectile is fired, the condition may repeat resulting in an uncontrolled continuous fire situation.

It is therefore vital that the trigger mechanism of a weapon reduce the potential for a misfire. Accordingly, there is a need for a trigger mechanism that more effectively prevents misfire conditions by securing the hammer before it can rotate forward to strike a second round of ammunition.

SUMMARY OF THE TECHNOLOGY

A trigger mechanism according to various aspects of the present technology is configured to provide a more effective method of securing a hammer after a firearm is fired. Various embodiments of the trigger mechanism comprise a main sear and a sear link that are used to mechanically link a trigger body to the hammer. The main sear maintains engagement with the hammer throughout an actuation cycle and is configured to catch the hammer as it rotates after striking a round of ammunition.

BRIEF DESCRIPTION OF THE DRAWINGS

A more complete understanding of the present technology may be derived by referring to the detailed description and claims when considered in connection with the following illustrative figures. In the following figures, like reference numbers refer to similar elements and steps throughout the figures.

Elements and steps in the figures are illustrated for simplicity and clarity and have not necessarily been rendered according to any particular sequence. For example, steps that may be performed concurrently or in a different order are illustrated in the figures to help to improve understanding of embodiments of the present technology.

DETAILED DESCRIPTION OF EXEMPLARY EMBODIMENTS

The present technology may be described in terms of functional block components and various processing steps. Such functional blocks may be realized by any number of components configured to perform the specified functions and achieve the various results. For example, the present technology may employ various materials, finishes, dimensions, and geometries, which may carry out a variety of operations suited to a specified application or environment. In addition, the present technology may be practiced in conjunction with any number of systems configured for operation with firearms, and the system described is merely one exemplary application for the invention. Further, the present technology may employ any number of conventional techniques for controlling a firing rate of a firearm, firing a round of ammunition or other projectile, preventing misfires, and the like.

A trigger mechanism according to various aspects of the present technology may operate in conjunction with any type of semi-automatic or automatic firearm. Various representative implementations of the present technology may be applied to any type of firearm including a hand gun or rifle and the disclosed system may be retrofit into any suitable existing firearm.

Figure 1:
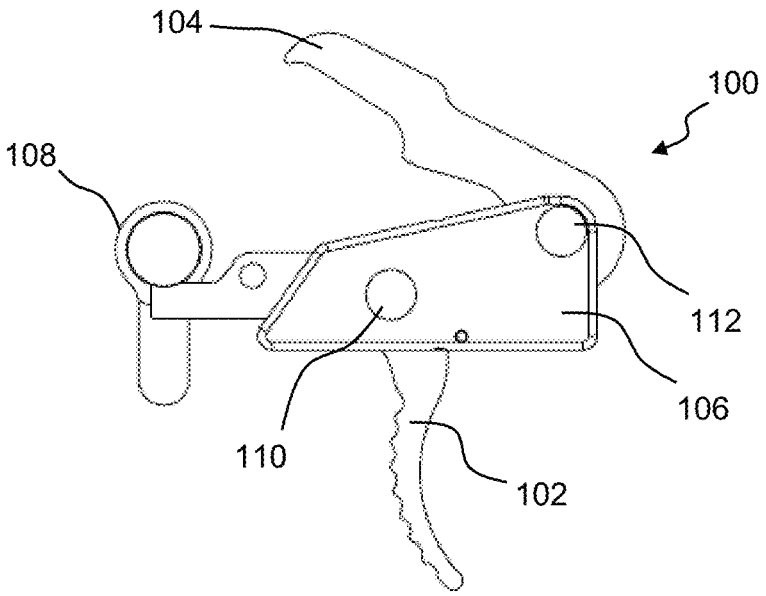
FIG. 1 representatively illustrates a side view of a trigger mechanism in accordance with an exemplary embodiment of the present technology.
Figure 2:
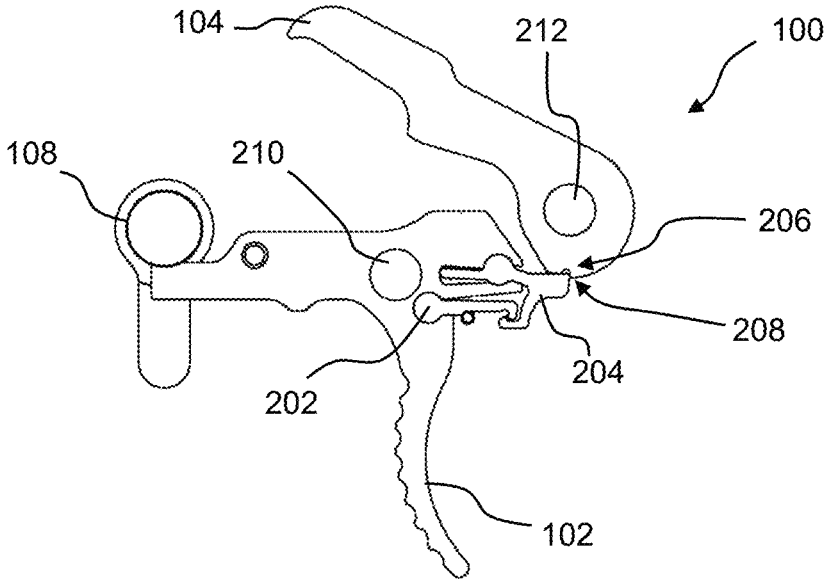
FIG. 2 representatively illustrates a side view of the trigger mechanism with a trigger housing removed in accordance with an exemplary embodiment of the present technology.
Figure 3:
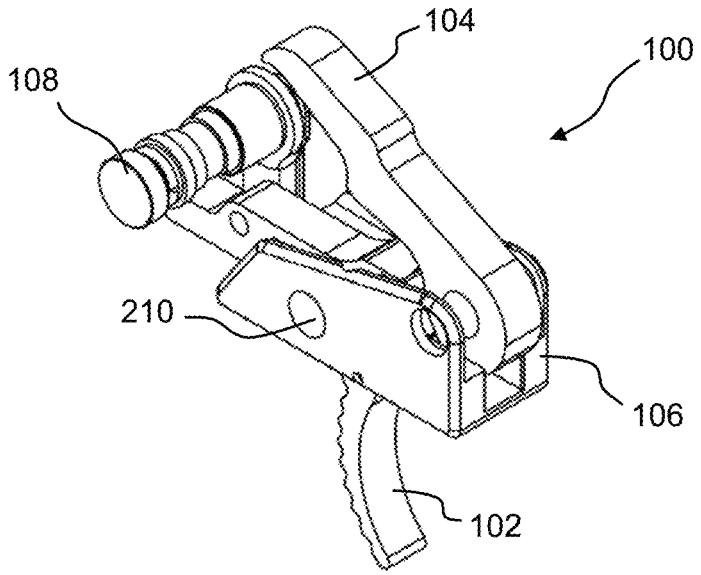
FIG. 3 representatively illustrates a perspective view of the trigger mechanism in accordance with an exemplary embodiment of the present technology.

Referring to FIGS. 1 and 2, a trigger mechanism 100 may generally comprise a trigger body 102, a hammer 104, and a trigger housing 106. The trigger mechanism 100 may also include or interact with a selector switch 108. The trigger housing 106 may be configured to at least partially enclose or house additional components or moving parts such as: various springs, pins, a sear link 202, and a main sear 204 that functionally link the trigger body 102 to the hammer 104.

Figure 4:
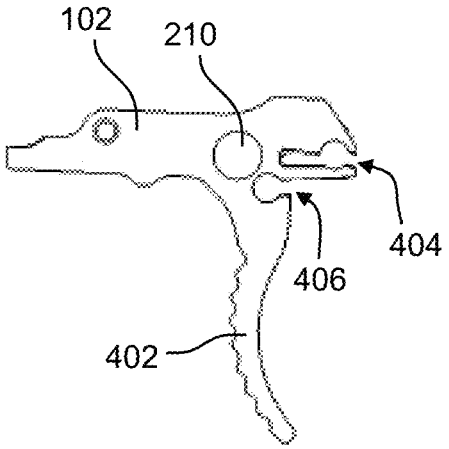
FIG. 4 representatively illustrates a side view of a trigger body in accordance with an exemplary embodiment of the present technology.
Figure 5:
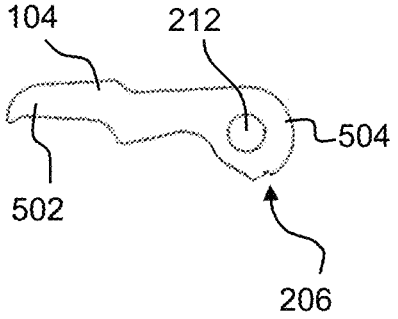
FIG. 5 representatively illustrates a side view of a hammer in accordance with an exemplary embodiment of the present technology.
Figure 6:
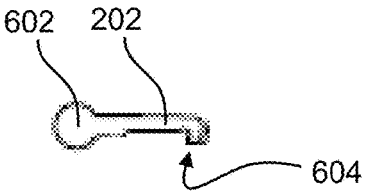
FIG. 6 representatively illustrates a side view of a sear link in accordance with an exemplary embodiment of the present technology.
Figure 7:
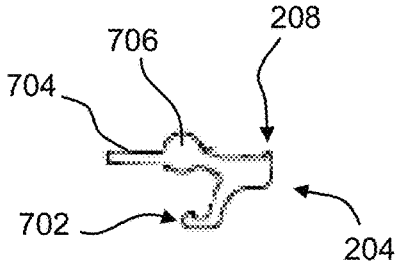
FIG. 7 representatively illustrates a side view of a main sear in accordance with an exemplary embodiment of the present technology.
Figure 8:
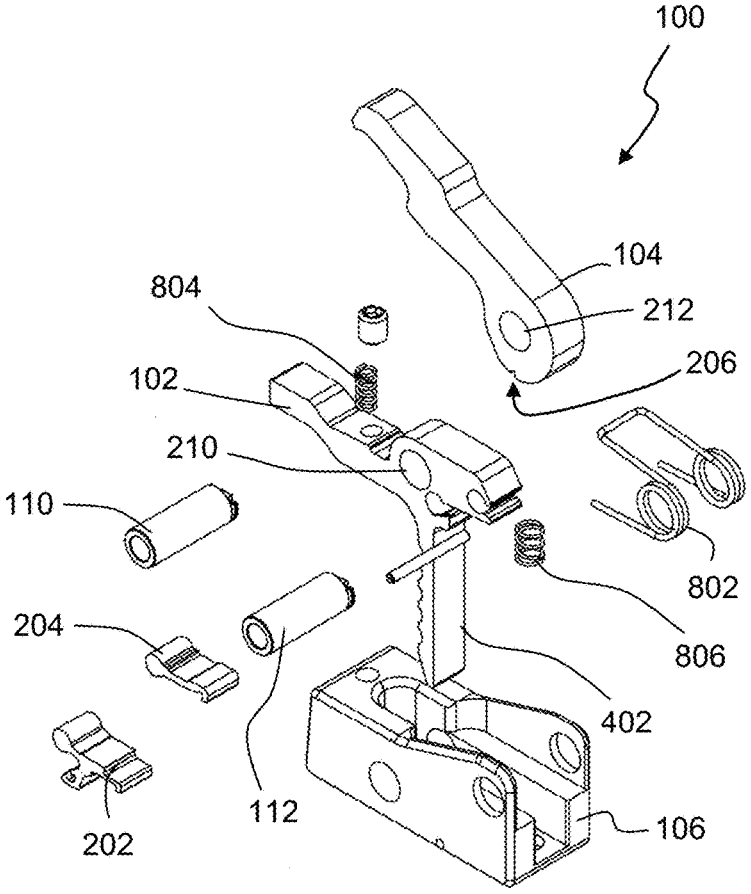
FIG. 8 representatively illustrates an exploded perspective view of the trigger mechanism in accordance with an exemplary embodiment of the present technology.

The trigger body 102 is used to selectively release the hammer 104 from a first position allowing it to rotate forward to strike a primer at a rim of an ammunition round causing the round to be fired from the firearm. The trigger body 102 may comprise any suitable device or system for activating the hammer 104. Referring now to FIGS. 2 and 4, the trigger body 102 may comprise a downwardly extending trigger section 402 that may be configured to at least partially conform to a portion of a user's finger, a first receiving section 404 positioned in a forward portion of the trigger body 102, and a second receiving section 406 disposed between the trigger section 402 and the first receiving section 404 in the forward portion of the trigger body 102. Alternatively, and referring now to FIGS. 8 and 9, the trigger section 402 may comprise a substantially flat surface. The trigger body 102 may also be configured to rotate about a pivot point 210 in response to a pressure force being applied to the trigger section 402. As the trigger body 102 rotates about the pivot point 210 in response to an applied trigger pressure, the first and section receiving sections 404, 406 change position causing the hammer 104 to be released from the first position.

Referring now to FIGS. 1, 2, 3, and 8, the trigger body 102 may be coupled to the trigger housing 106 by a first pin or sleeve 110. The first sleeve 110 may extend from a first side of the trigger housing 106 through the pivot point 210 of the trigger body 102 and to a second side of the trigger housing 106. Once coupled together, the trigger body 102 may rotate relative to the housing 106 about the pivot point 210 and first sleeve 110.

Referring now to FIGS. 2, 4, 5, 7, and 8, the first receiving section 404 may comprise a recessed area configured to receive at least a portion of the main sear 204. For example, the main sear 204 may comprise an insertion end 704 and a pivot portion 706 configured to substantially conform to or have roughly the same shape as the first receiving section 404. A portion of the first receiving section 404 may comprise a slightly larger height than a thickness of the insertion end 704 such that the main sear 204 is free to rotate slightly about a pivot portion 706 (FIGS. 2 and 13A-13C).

The main sear 204 may further comprise a link point 702 and a catch point 208. The link point 702 may be configured to engage the sear link 202 when the hammer 104 is in the first position to lock the trigger mechanism 100 in position. In one embodiment, the link point 702 may comprise a downwardly extending lower portion of the main sear 204 forming a hook-like section suitably configured to engage and be held into position by the sear link 202.

The catch point 208 may comprise a portion of the main sear 204 disposed along an upper surface that is configured to remain in contact with the hammer 104 during an actuation cycle when the hammer 104 rotates away from and back to the first position. For example, the catch point 208 may comprise a protruding section along the upper surface of the main sear 204 that is configured to slide along an outer surface of the hammer 104 and engage a mating recess 206 on the surface of the hammer 104 when the hammer 104 returns to the first position. The engagement of the catch point 208 and the recess 206 serve to lock the hammer 104 in position to prevent any further rotation.

Referring now to FIGS. 2, 4, 6, 8, and 10, the second receiving section 406 may comprise a second recessed area configured to receive the sear link 202. The sear link 202 may comprise a rounded end portion 602 configured to substantially conform to or have roughly the same shape and dimensions as the second receiving section 406. The rounded end portion 602 is configured to rotate within the second receiving section 406 as the trigger body 102 rotates. The sear link 202 may also comprise a hooked end portion 604 suitably configured to engage the link point 702 as described above.

The hammer 104 rotates from a first position to strike a firing pin (not shown) on the ammunition round (not shown). Upon firing of the round, recoil forces are used to return the hammer 104 to the first position. The hammer 104 may comprise any suitable device or system for causing the round to be fired in response to a force being applied to the trigger section 402 of the trigger body 102. Referring now to FIGS. 1, 2, 3, 5, 8, and 10, in one embodiment, the hammer 104 may comprise a body having a first end portion 502 with a surface configured to contact a firing pin of the ammunition round and a second end portion 504 having a hole 212 therethrough about which the hammer 104 rotates. For example, the hammer 104 may be coupled to the trigger housing 106 by a second pin or sleeve 112 configured to extend from the first side of the trigger housing 106, through the hole 212, and to the second side of the trigger housing 106. The hammer 104 may then rotate about the hole 212 and the second sleeve 112 during the actuation cycle.

An outer surface of the end portion 504 of the hammer 104 may be configured to engage the main sear 204 to be locked into the first position. For example, the recess 206 may be positioned along an outer surface of the hammer 104. As the hammer 104 rotates during the actuation cycle, the recess 206 is moved towards the main sear 204 such that the catch point 208 slides into the recessed section 206 locking the hammer 104 in place and preventing any further rotation until the trigger section 402 is pressed again.

The trigger mechanism 100 may further comprise additional components suitably configured to facilitate the release, rotation, and catching of the hammer 104 during use. For example, referring now to FIGS. 8 and 9, the trigger mechanism 100 may further comprise a hammer spring 802 configured to apply a force to the hammer 104 when the trigger section 402 is pressed, a main sear spring 806 positioned within a forward portion of the housing 106 and configured to apply a upwardly biasing force to a lower surface of the main sear 204, and a set spring 904 positioned within the trigger body 102 and configured to apply a downwardly biasing force to an upper surface of the sear link 202.

Figure 11:
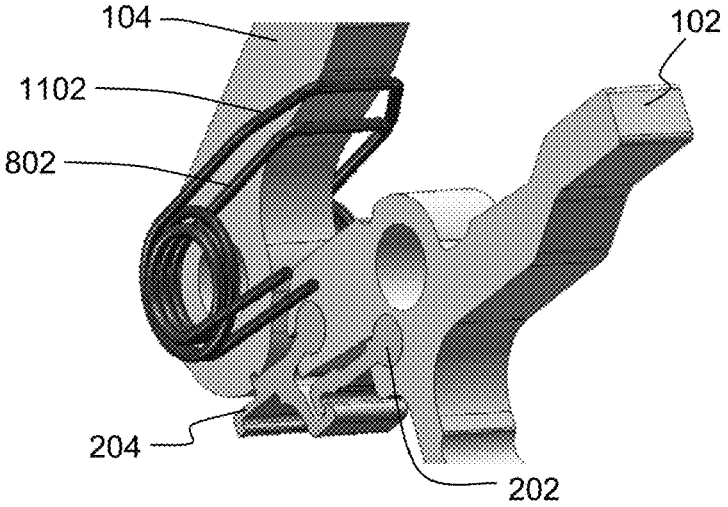
FIG. 11 representatively illustrates a perspective view of a hammer spring in accordance with an exemplary embodiment of the present technology.

The hammer spring 802 may comprise any suitable device or system for causing second end portion 504 of the hammer 104 to rotate forward. In one embodiment the hammer spring 802 may comprise a torsion spring coupled to the hammer 104 by the second sleeve 112 and received within the trigger housing 106. The torsion spring may be positioned within the trigger mechanism 100 such that it applies a force that tends to rotate the first end portion 502 forward. Referring now to FIG. 11, in an alternative embodiment, a second hammer spring 1102 may be positioned immediately adjacent to the first hammer spring 802 to provide additional rotational force to the hammer 104 after the trigger section 402 is pulled.

Figure 10:
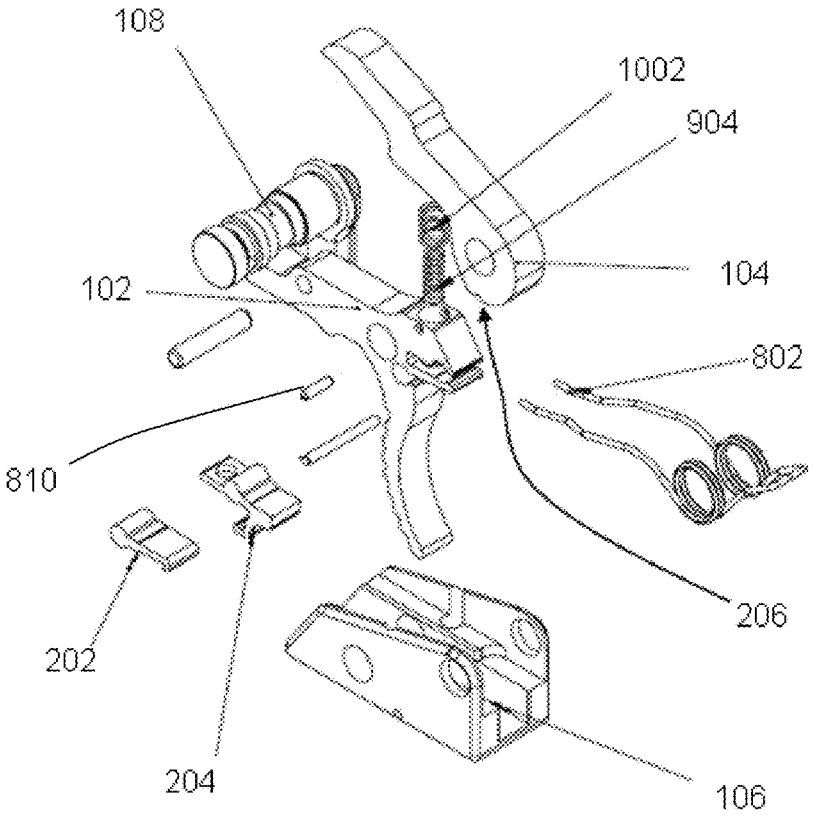
FIG. 10 representatively illustrates an exploded perspective view of an alternative embodiment of the trigger mechanism in accordance with an exemplary embodiment of the present technology.

In an alternative embodiment and referring now to FIG. 10, the trigger mechanism 100 may further comprise a dual spring arrangement configured to apply a downwardly biasing force to both an upper surface of the main sear 204 and the sear link 202. The dual spring arrangement may be positioned within the trigger body 102 in a manner to provide the downward force to the main sear 204 and the sear link 202. For example, a main spring 1002 may comprise a coil spring configured to fit within a recess in a top portion of the trigger body 102 and the set spring 904 may comprise a coil spring having a smaller diameter than that of the main spring 1002 such that it can be positioned within an open center portion of the main spring 1002. The main spring 1002 may contact the insertion end 704 of the main sear 204 and apply a downward force. The insertion end 704 of the main sear 204 and the trigger housing 106 may each comprise an opening sized to allow the set spring 904 to pass through the main sear 204 and a portion of the trigger housing 106 and come into contact with the sear link 202. The main spring 1002 and the set spring 904 may be held in position by a spring retaining pin 810.

Figure 9:
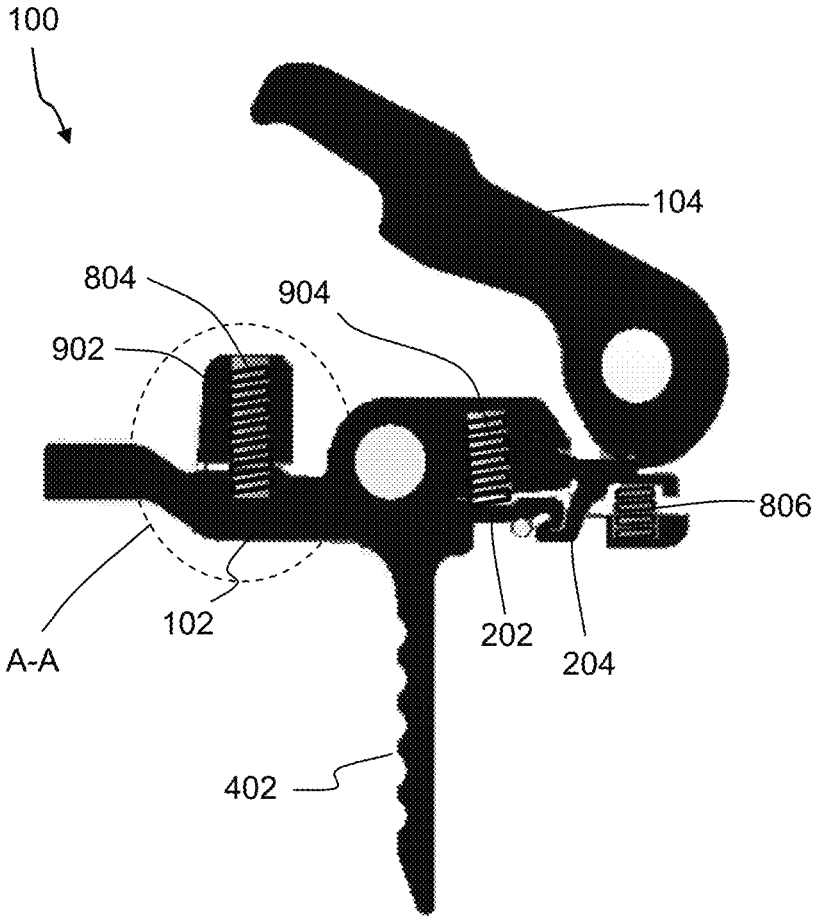
FIG. 9 representatively illustrates a cutaway side view of the trigger mechanism in accordance with an exemplary embodiment of the present technology.
Figure 12A:
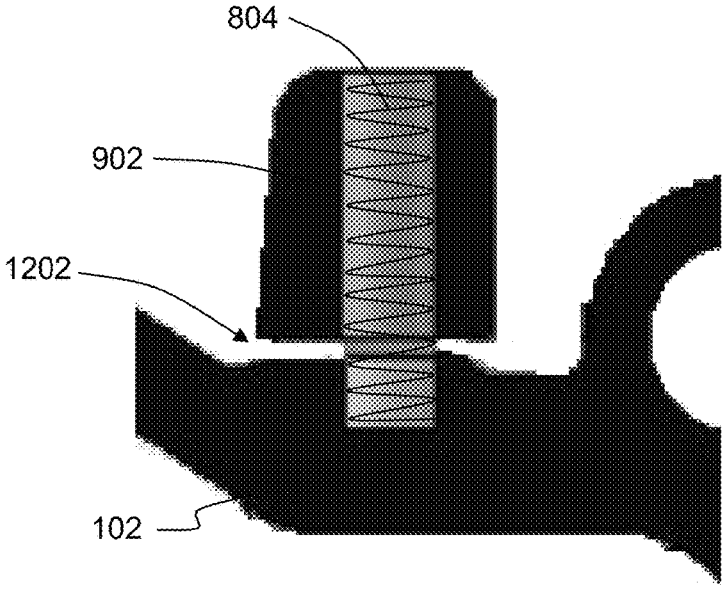
FIG. 12A representatively illustrates a detailed view of section A-A in FIG. 9 of the trigger body in a first position relative to a trigger stop in accordance with an exemplary embodiment of the present technology.
Figure 12B:
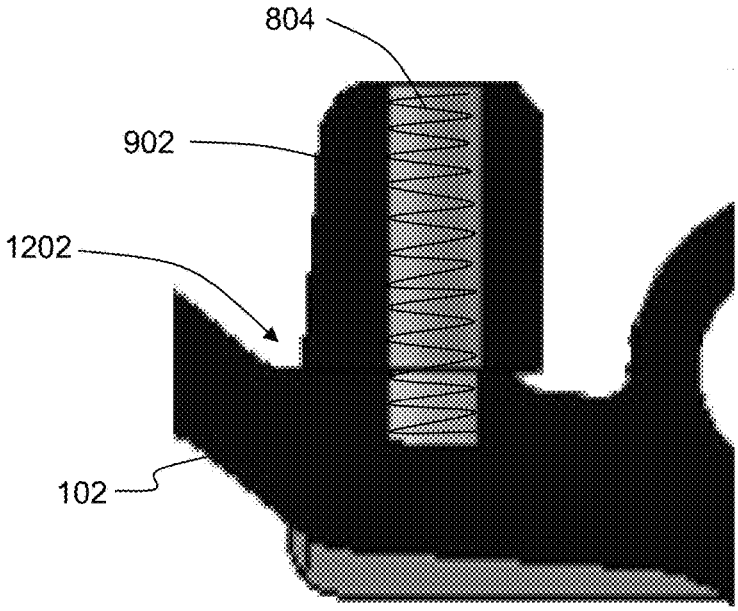
FIG. 12B representatively illustrates the detailed view of section A-A in FIG. 9 of the trigger body in a second position abutting the trigger stop in accordance with an exemplary embodiment of the present technology.

Referring now to FIGS. 9, 12A, and 12B, the trigger mechanism 100 may further comprise a trigger stop 902 configured to limit the rotation of the trigger body 102. In one embodiment, the trigger stop 902 may be positioned at some predetermined distance above a rear portion of the trigger body 102 inside of the housing 106. For example, when the trigger mechanism 100 is in the first position (hammer 104 locked, shown in FIG. 12A), the trigger body 102 and the trigger stop 902 may be separated by a gap 1202. When the force is applied to the trigger section 402 and the trigger body 102 rotates the rear portion of the trigger body 102 may move upwards and contact the trigger stop 902 eliminating the gap 1202, shown in FIG. 12B. This contact prevents any further rotation of the trigger body 102. The trigger stop 902 may also comprise a return spring 804 configured to act upon an upper surface of the trigger body 102 to help return the trigger body 102 to the first position, shown in FIG. 12A.

During use, the trigger body 102, main sear 204, and sear link 202 rotate through various ranges of motion during the actuation cycle from holding the hammer 104 in the first position, releasing the hammer 104 to fire the round, and catching and securing the hammer 104 back in the first position, before returning to a ready to fire state. For example, referring now to FIG. 13A, in a first resting state, the hammer 104 may be positioned in the first position that represents a ready to fire state. In this state, the main sear 204 and sear link 202 are fully engaged with each other and the catch point 208 of main sear 204 is engaged with the recess 206 locking the hammer 104 in place.

Figure 13A:
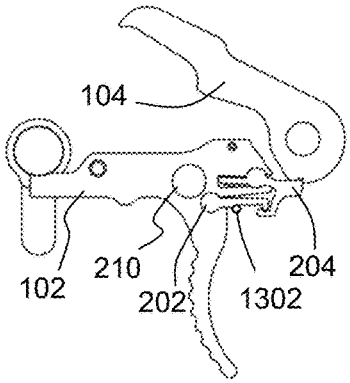
FIGS. 13A-13H representatively illustrate an actuation cycle of the trigger mechanism in accordance with an exemplary embodiment of the present technology.
Figure 13B:
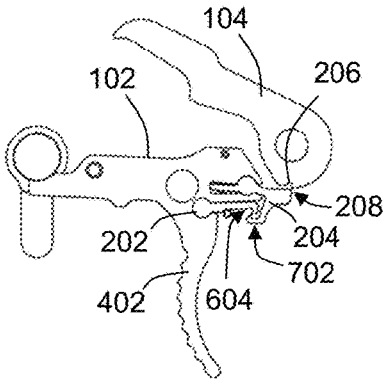

Referring now to FIG. 13B, as the trigger section 402 of the trigger body 102 is pressed, the trigger body 102 begins to rotate about the pivot point 210 causing the sear link 202 and the main sear 204 to begin to move downwards in conjunction with the trigger body 102. As the sear link 202 moves downward it engages a fixed pin 1302 which causes the sear link 202 to begin to rotate counter to the direction the trigger body 102 is moving or rotating. As the trigger body 102 continues to move downward, the main sear 204 begins to disengage or otherwise lose contact with the sear link 202. At the same time, the general downward movement of the main sear 204 causes the catch point 208 to disengage or otherwise lose contact with the recess 206 of the hammer 104.

Figure 13C:
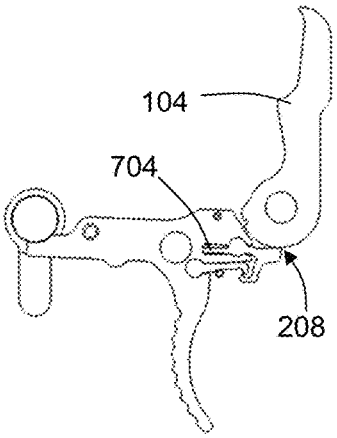

Referring now to FIG. 13C, after the catch point 208 has completely separated from the recess 206, the hammer 104 rotates forward under the force of the hammer spring 802 from the first position to a fired position. Shortly thereafter the main sear 204 and the sear link 202 also completely lose contact with each other and the upward force applied by the main sear spring 806 on the foward portion of the main sear 204 causes the main sear 204 to rotate slightly about the pivot portion 706 such that the catch point 208 is pressed against the outer surface of the hammer 104 and the insertion end 704 engages a lower surface of the first receiving section 404.

Figure 13D:
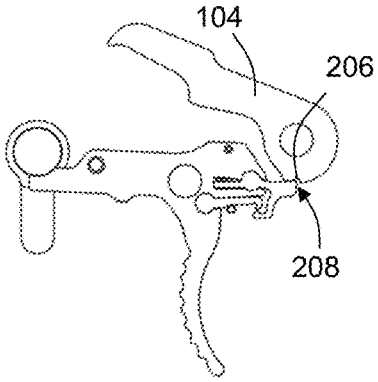
Figure 13E:
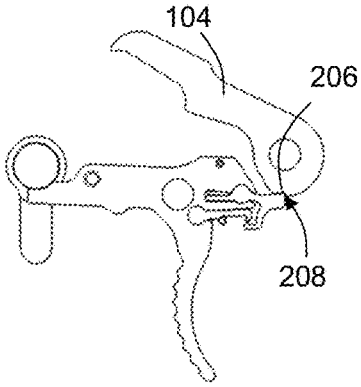

Referring now to FIG. 13D, after the round is fired, the recoil force created is used to rotate the hammer 104 back towards the first position. As the hammer 104 rotates, the recess 206 rotates back towards the catch point 208. Referring now to FIG. 13E, as the hammer 104 continues to rotate, the catch point 208 and the recess 206 come back into contact with each other and the main sear 204 rotates slightly further allowing the catch point 208 to slide into the recess 206 locking the hammer 104 back into the first position.

Figure 13F:
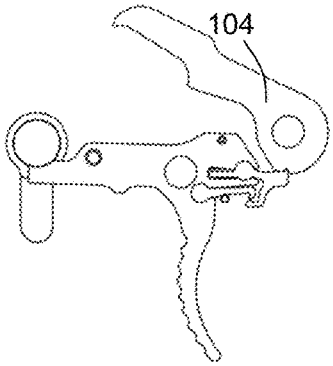
Figure 13G:
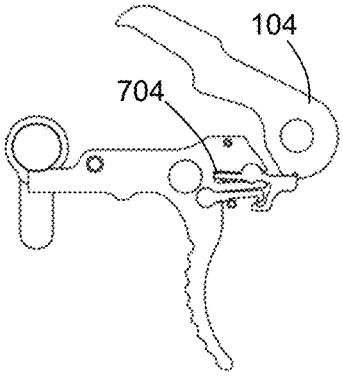
Figure 13H:
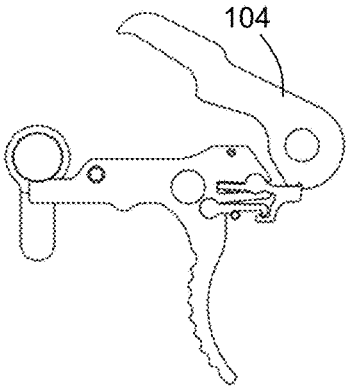

Referring now to FIG. 13F-13H, after the hammer 104 is locked into the first position, the forward portion of the trigger body 102 begins to rotate in a generally upward manner back to its initial position as the force on the trigger section 402 is released. The main sear 204 remains locked against the hammer 104 under the force of the main sear spring 806 while the trigger body 102 and the sear link 202 begin to move generally upwards to their original position. This causes the insertion end 704 to move from the lower surface of the first receiving section 404 to an upper surface of the first receiving section 404 (FIG. 13G). As the force on the trigger body 102 is fully released, the sear link 202 and the main sear 204 come back into full engagement with each other, ending the actuation cycle and returning the trigger mechanism 100 to the first state (FIG. 13H).

These and other embodiments for methods of actuating and securing a hammer may incorporate concepts, embodiments, and configurations as described above. The particular implementations shown and described are illustrative of the technology and its best mode and are not intended to otherwise limit the scope of the present technology in any way. Indeed, for the sake of brevity, conventional manufacturing, connection, preparation, and other functional aspects of the system may not be described in detail. Furthermore, the connecting lines shown in the various figures are intended to represent exemplary functional relationships and/or physical couplings between the various elements. Many alternative or additional functional relationships or physical connections may be present in a practical system.

The technology has been described with reference to specific exemplary embodiments. Various modifications and changes, however, may be made without departing from the scope of the present technology. The description and figures are to be regarded in an illustrative manner, rather than a restrictive one and all such modifications are intended to be included within the scope of the present technology. Accordingly, the scope of the technology should be determined by the generic embodiments described and their legal equivalents rather than by merely the specific examples described above. For example, the steps recited in any method or process embodiment may be executed in any order, unless otherwise expressly specified, and are not limited to the explicit order presented in the specific examples. Additionally, the components and/or elements recited in any apparatus embodiment may be assembled or otherwise operationally configured in a variety of permutations to produce substantially the same result as the present technology and are accordingly not limited to the specific configuration recited in the specific examples. Benefits, other advantages and solutions to problems have been described above with regard to particular embodiments; however, any benefit, advantage, solution to problems or any element that may cause any particular benefit, advantage or solution to occur or to become more pronounced are not to be construed as critical, required or essential features or components.

As used herein, the terms "comprises", "comprising", or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present technology, in addition to those not specifically recited, may be varied or otherwise particularly adapted to specific environments, manufacturing specifications, design parameters or other operating requirements without departing from the general principles of the same.

The present technology has been described above with reference to an exemplary embodiment. However, changes and modifications may be made to the exemplary embodiment without departing from the scope of the present technology. These and other changes or modifications are intended to be included within the scope of the present technology, as expressed in the following claims.

The invention claimed is:

1. A trigger mechanism, comprising:
- a trigger body, comprising:
  - a downwardly extending trigger section;
  - a first receiving section positioned in a forward portion of the trigger body; and
  - a second receiving section disposed between the trigger section and the first receiving section in the forward portion of the trigger body;
- a main sear, comprising:
  - an insertion end configured to be positioned within the first receiving section;
  - a catch point opposite the insertion end; and
  - a downwardly extending link point;
- a sear link, comprising:
  - a first end portion configured to be positioned within the second receiving section; and
  - a second end portion configured to engage the link point; and
- a hammer comprising a recess disposed along an outer surface of the hammer and configured to engage the catch point.

2. A trigger mechanism according to claim 1, further comprising a housing wherein:
- the housing is coupled to a pivot point of the trigger body by a first sleeve; and
- the housing is coupled to an end portion of the hammer by a second sleeve.

3. A trigger mechanism according to claim 2, further comprising a main sear spring disposed within a forward portion of the housing and configured to act upon a lower surface of the main sear.

4. A trigger mechanism according to claim 2, wherein the housing comprises a trigger stop positioned within a rear portion of the housing and configured to engage an upper surface of the trigger body after the trigger is pulled.

5. A trigger mechanism according to claim 2, further comprising a hammer spring coupled around the second sleeve between the housing and the hammer.

6. A trigger mechanism according to claim 5, further comprising a second hammer spring coupled around the second sleeve between the housing and the hammer immediately adjacent to the first hammer spring.

7. A trigger mechanism according to claim 1, further comprising a set spring disposed within the trigger body and configured to act upon an upper surface of the sear link.

8. A trigger mechanism according to claim 7, further comprising a main sear spring disposed within the trigger body, wherein:
- the main sear spring comprises a larger diameter than the set spring and is positioned over the set spring and is configured to act upon an upper surface of the main sear; and
- the main sear comprises a through hole to allow the set spring to pass through to engage the sear link.

9. A trigger mechanism, comprising:
- a trigger body having a pivot point;
- a main sear coupled to the trigger body, comprising:
  - a catch point; and
  - a downwardly extending link point;
- a sear link coupled to the trigger body below the main sear, comprising an end portion configured to engage the link point;
- a hammer comprising a recessed section configured to engage the catch point; and
- housing configured to:
  - receive the trigger body and be coupled to the pivot point by a first sleeve; and
  - receive and be coupled to an end portion of the hammer by a second sleeve.

10. A trigger mechanism according to claim 9, further comprising a main sear spring disposed within a forward portion of the housing and configured to act upon a lower surface of the main sear.

11. A trigger mechanism according to claim 9, wherein the housing comprises a trigger stop positioned within a rear portion of the housing and configured to engage an upper surface of the trigger body after the trigger is pulled.

12. A trigger mechanism according to claim 9, further comprising a hammer spring coupled around the second sleeve between the housing and the hammer.

13. A trigger mechanism according to claim 12, further comprising a second hammer spring coupled around the second sleeve between the housing and the hammer immediately adjacent to the first hammer spring.

14. A trigger mechanism according to claim 9, further comprising a set spring disposed within the trigger body and configured to act upon an upper surface of the sear link.

15. A trigger mechanism according to claim 14 further comprising a main sear spring disposed within the trigger body, wherein:
- the main sear spring comprises a larger diameter than the set spring and is positioned over the set spring and acts upon an upper surface of the main sear; and
- the main sear comprises a through hole to allow the set spring to pass through to engage the sear link.

* * * * *